US011951412B2

(12) United States Patent
Hsu et al.

(10) Patent No.: US 11,951,412 B2
(45) Date of Patent: Apr. 9, 2024

(54) PLUSH TOY WITH CHANGEABLE FACE

(71) Applicant: Great Eastern Entertainment Co., Compton, CA (US)

(72) Inventors: Kent Hsu, Torrence, CA (US); Nancy Chen, Taipei (TW)

(73) Assignee: Great Eastern Entertainment Co., Compton, CA (US)

( * ) Notice: Subject to any disclaimer, the term of this patent is extended or adjusted under 35 U.S.C. 154(b) by 179 days.

(21) Appl. No.: 17/698,993

(22) Filed: Mar. 18, 2022

(65) Prior Publication Data

US 2023/0294009 A1 Sep. 21, 2023

(51) Int. Cl.
*A63H 3/12* (2006.01)
*A63H 3/02* (2006.01)
*A63H 3/44* (2006.01)

(52) U.S. Cl.
CPC ..... *A63H 3/12* (2013.01); *A63H 3/02* (2013.01); *A63H 3/44* (2013.01)

(58) Field of Classification Search
CPC ..... A63H 3/12; A63H 3/02; A63H 3/44
USPC ..... 446/97–101, 321, 338, 369, 391
See application file for complete search history.

(56) References Cited

U.S. PATENT DOCUMENTS 1,618,772 A * 2/1927 Merseburger ..... A63H 3/12 446/351
2,584,798 A * 2/1952 Goerditz ..... A63H 3/12 446/353
3,811,220 A * 5/1974 Glass ..... A63H 3/12 446/371
3,851,419 A * 12/1974 Kaelin ..... A63H 3/12 446/321
3,861,078 A * 1/1975 Snyder ..... A63H 3/12 428/912.2
4,136,483 A * 1/1979 Shackelford ..... A63H 3/12 446/394
4,336,665 A 6/1982 Moreau
4,413,442 A 11/1983 McSweeney
4,580,992 A 4/1986 Mckay
4,781,648 A 11/1988 Garfinkel
5,046,985 A * 9/1991 Cearfoss ..... A63H 33/22 446/337
6,443,802 B1 * 9/2002 Vakili ..... A63H 3/12 446/368
6,945,841 B2 9/2005 Becker et al.
6,962,517 B2 11/2005 Murray
9,925,474 B1 3/2018 Sutton
10,201,762 B2 2/2019 Sutton
(Continued)

FOREIGN PATENT DOCUMENTS

GB 2199761 A * 7/1988 ..... A63H 3/36

*Primary Examiner* — Nini F Legesse
(74) *Attorney, Agent, or Firm* — McConnell Law Firm P.C.; Robert McConnell

(57) ABSTRACT

A plush toy that is configurable to change the face displayed on the toy. In a first embodiments, the hair is moveable to display a face flap that has a different face on each side of the flap. The flap can be positioned to display either side and face or can be stowed on the back of the toy's head to display a third face. In a second embodiment, a face strap is pulled to position a first and second face on the front of the plush toy. A third embodiment includes a moveable face hood that can be positioned in one of two positions to display two different faces.

11 Claims, 4 Drawing Sheets

(56) References Cited

U.S. PATENT DOCUMENTS

| | | | | |
|---|---|---|---|---|
| 2012/0208428 | A1* | 8/2012 | Zheng | A63H 3/44<br>446/391 |
| 2015/0306516 | A1* | 10/2015 | Stocker-Edwards | A63H 3/12<br>446/321 |
| 2018/0280819 | A1* | 10/2018 | Strauss | A63H 3/12 |
| 2019/0275436 | A1 | 9/2019 | Badie | |

* cited by examiner

PLUSH TOY WITH CHANGEABLE FACE

BACKGROUND OF THE INVENTION

Field of the Invention

The present invention relates to plush toys, specifically toys consisting of a soft exterior material covering either a soft or firm stuffing material. Plush toys are made of various exterior materials such as soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. These exterior materials are formed of synthetic materials such as polyester, nylon, plastics and/or natural materials such as cotton, wool or real fur. Common stuffing materials may include polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Plush toys are enjoyed by children and adults alike. Children or adults may use them solely for the enjoyment of play but many adults may collect them for enjoyment or financial gain. Plush toys are often based on characters ranging from zoo/farm animals to characters invented by their manufacturers to famous licensed characters such as super heroes or cartoon characters. Plush toys are a significant market enjoyed by those of all ages and all walks of life.

SUMMARY OF THE INVENTION

The plush toy disclosed in the present application is configurable to change the face displayed on the toy. In the first of three embodiments, the hair is moveable to display a face flap that has a different face on each side of the flap. The flap can be positioned to display either side and face or can be stowed on the back of the toy's head to display a third face.

In the second embodiment, a face strap is pulled to position a first and second face on the front of the plush toy. The hair is moveable to display the strap so the user may pull it to position the face in their choice of positions.

The third embodiment includes a moveable face hood that can be positioned in one of two positions to display two different faces. The moveable face hood rotates to hide one face and display the second.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

Figure 1:
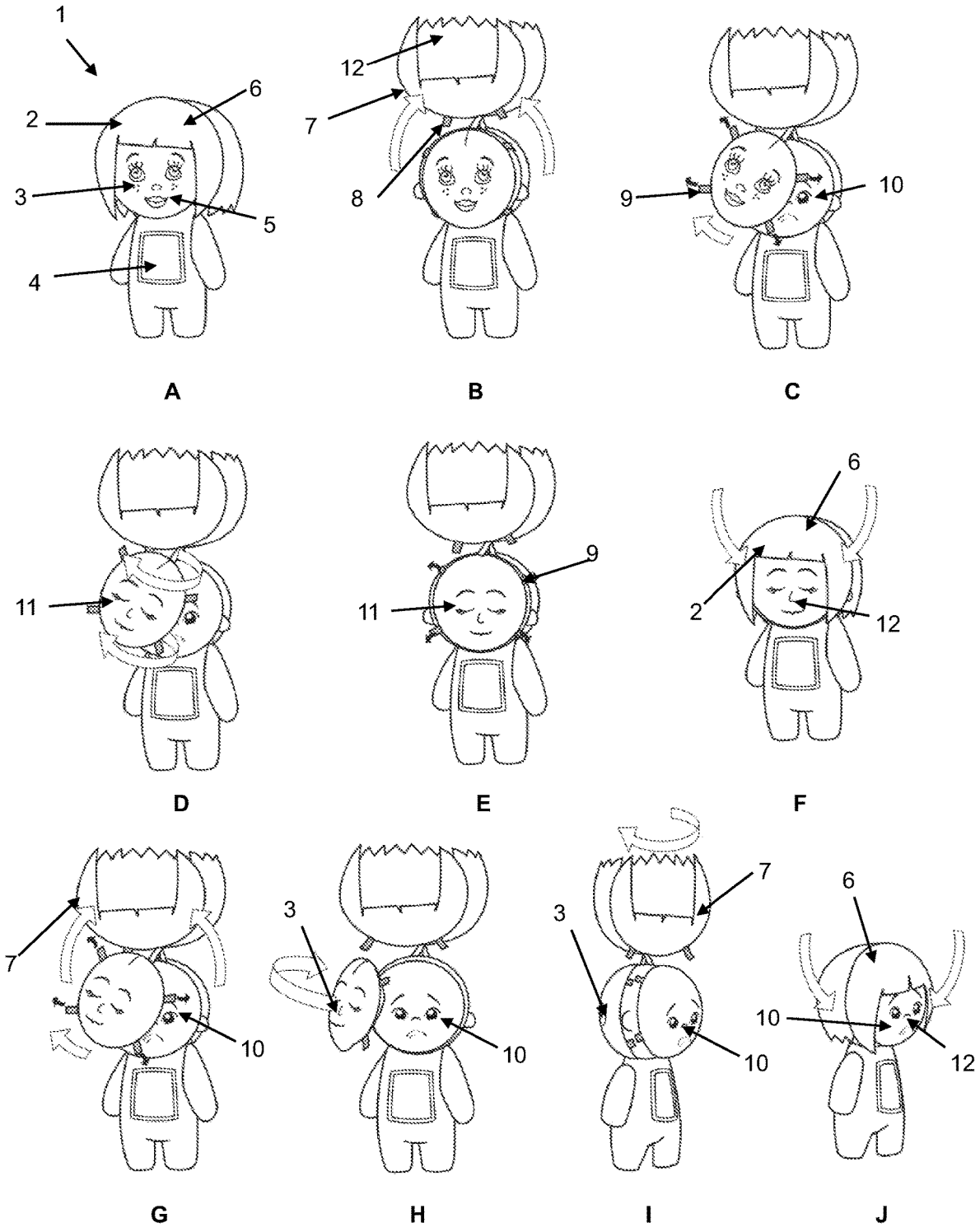
FIG. 1 shows steps A-J for changing the displayed face on a plush toy with a moveable face flap.

FIG. 1 is a view of the first embodiment of the present plush toy with changeable face. FIG. 1 further shows views of the plush toy in various steps of conversion from one face to another, with steps labeled A through J. Numbering of features of plush toy 1 identified in a previous steps A through J will be shown on the relevant step and feature numbers may not be shown again, unless changed or a state has changed. Plush toy 1 is shown in step A in its first configuration with a first face being displayed on plush toy 1. Movable hair 2 is shown in step A in its first position. Hair 2 has two positions: first hair position 6 and second hair position 7 (step B). Further, hair 2 has a first side with face display area 12 cut out of the first side and a second side with full hair. Face flap 3 also has two positions and is shown in its first position displaying first face 5 in step A. Face flap 3 has a first side and a second side. The first side displays first face 5 and the second side displays second face 11 (shown in step D). Plush toy body 4 is also shown.

In step B, hair 2 is shown in hair second position 7. Further, hair tabs 8 are also shown. In this embodiment, two hair tabs 8 are shown, but any number of tabs may be used to secure hair 2 in its first position.

Step C shows face 3 being lifted off plush toy 1 so that it can be repositioned to display its second side and display show second face 11. Further, third face 10 is shown under face flap 3 and can be displayed if face flap 3 is stowed behind the doll's head and behind hair 2. Step C further shows face flap tabs 9 in their disengaged step. Face flap tabs 9 are used to secure face flap 3 to the plush toy when face flap 3 is in its attached position as the face of plush toy 1. Step D shows face flap 3 flipped over with second face 11 displayed.

Step E shows face flap 3 in its attached position on the front of plush toy 1 with second face 11 is displayed. Further, face flap tabs 9 are in their attached position to secure face flap 3 to the face location of plush toy such that second face 11 is displayed. Step F shows hair 2 moved back to first hair position 6. In step F the transition to second face 11 is complete, with first face 5 hidden on the first side of face flap 3. Face flap 3 is further attached to plush toy 1 with face flap tabs 9 and hair tabs 8 used to secure face flap 3 to plush toy 1.

Step G shows the first step in the process to display third face 10. Here, hair 2 is moved to second hair position 6 and face flap 3 detached from plush toy 1 by detaching hair tabs 8 and face flap tabs 9. Step H shows face flap 3 being rotated to the back of the head of plush toy 1 so that third face 10 will be visible. Step I shows face flap 3 being attached to the back of the head of plush toy 1 using face flap tabs 9. Hair 2, in second hair position 7, is rotated such that the second side of hair 2, with full hair, completely covers and hides face flap 3, so that only third face 10 is visible. Hair 2 is oriented such that third face 10 is visible through the face display area 12 of hair 2 side one. Lastly, Step J shows the final configuration of plush toy 1 with third face 10 displayed and hair 2 in second position 6.

Figure 2:
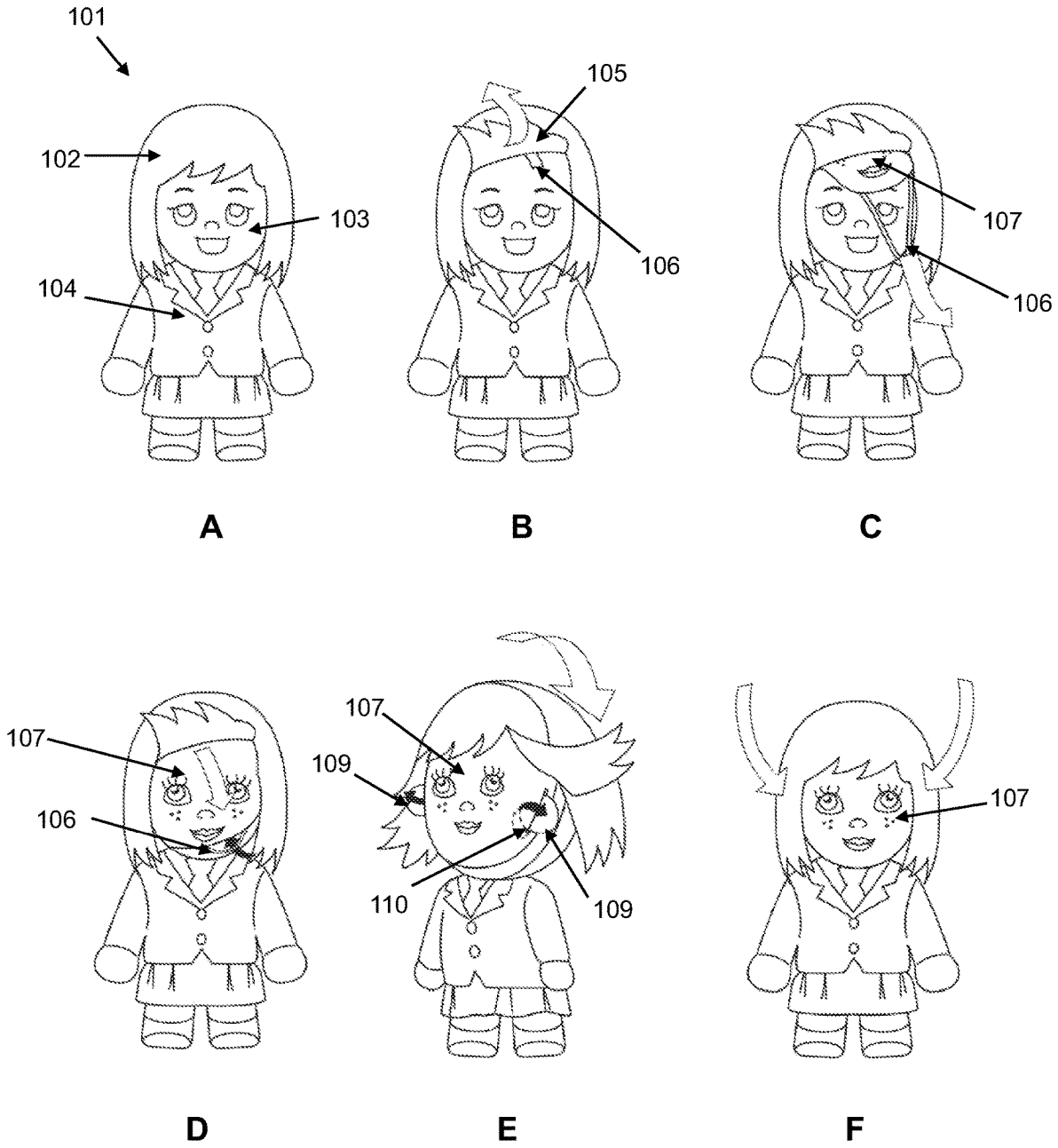
FIG. 2 shows steps A-F for changing the displayed face on a plush toy by utilizing a face strap.

FIG. 2 shows a second embodiment of plush toy 101 with a changeable face. The process of changing the displayed face for this embodiment are shown in steps A-F. In step A, plush toy 101 is shown with first face 103 visible. Plush toy 101 also comprises body 104 and hair 102. Step B shows hair flap 105 being lifted to reveal face strap 106. Hair flap 105 covers face strap 106 and second face 107 (as shown in step C). Second face 107 comprises a second face for display on plush toy 101 and face strap 106 allows the user to pull the hidden second face 107 from behind hair 102. In step C, the user pulls face strap 106 to pull second face 107 down, which is hidden behind hair 102. Step D shows the progression of movement of second face 107 as pulled by face strap 106. In this view, second face 107 is almost completely visible. Step E shows second face 107 completely installed over first face 103. Face tab 109 secures second face 107 to plush toy 101 by fitting through face tab hole 110. In this embodiment, there are two face tabs 109 pulled through two face tab holes 110, but any number of face tabs 109 and matching face tab holes 110. may be used. Step F shows the final state of the plush toy 101 with the second face 107 displayed and hair 102 pulled down to hide the first face 103 now hidden behind it.

Figure 3:
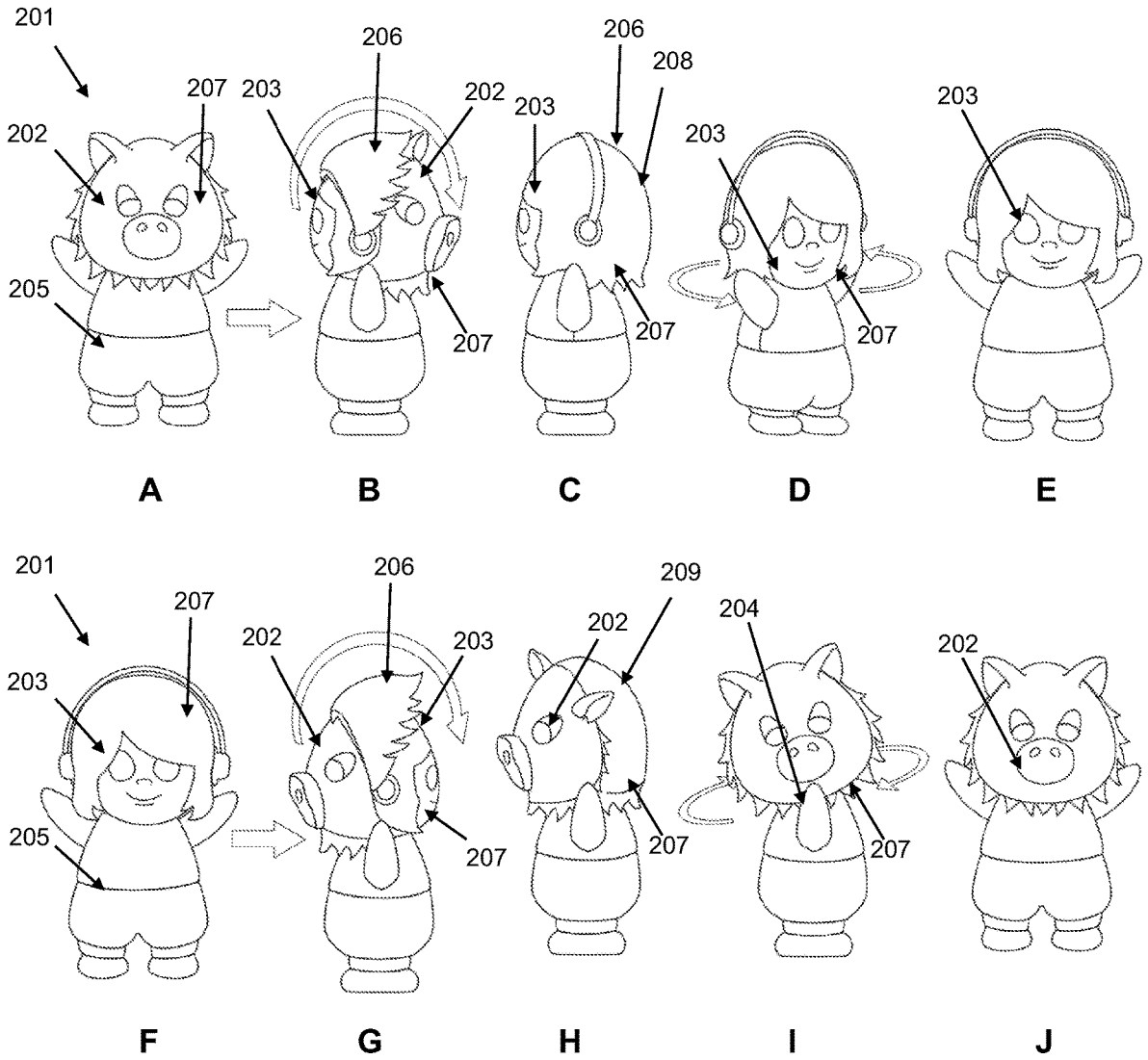
FIG. 3 shows steps A-J for changing the displayed face on a plush toy utilizing a moveable face hood.

FIG. 3 shows a third embodiment of plush toy 201 with a changeable face. The process for changing the face in the third embodiment is shown in steps A-J. Plush toy 201 shown in step A comprises first face 202, head 207 and body 205. Body 205 includes a front side, specifically the side of the body normally aligned with the face, and a second side, the side normally aligned with the back of the head/rear of the body. The face changing functionality for this embodiment is enabled by a moveable face hood 206 as shown in Step B. Moveable face hood 206 is comprised of a piece of fabric that has two sides, each side showing the back of the head for one of the two available faces. The moveable face hood 206 also hides one of the two available faces of plush toy 201 depending on its location. Step B presents a side view of plush toy 201, showing moveable face hood 206 in motion between a first position and a second position. Moveable face hood 206 covers head 207 of plush toy 201 and may be configured in a first position where first face 202 and first back of head 209 are visible or a second position where second face 203 and second back of head 208 are visible. When moveable face hood 206 is pulled over the head of plush toy 201, the configuration of plush toy 201 is changed from displaying first face 202 to displaying second face 203. Moveable face hood 206 is attached to the sides of head 207 in such a way that it can be moved from its first position to its second position without becoming detached from head 207. In step C, the transition of moveable face hood 206 is complete, and second face 203 is fully visible. In step D, head 207 is rotated around its horizontal axis to move second face 203 to align with the front side of body 205 such that second face 203 is displayed on the front of plush toy 201. Step E shows the final product of the transition with second face 203 displayed on the front of plush toy 201. Steps F-J outline the reverse transition from second face 203 to first face 202 by moving moveable face hood 206 from the second position with second face 203 and second back of head 208 visible to the first position with first face 202 and first back of head 209 visible.

Figure 4:
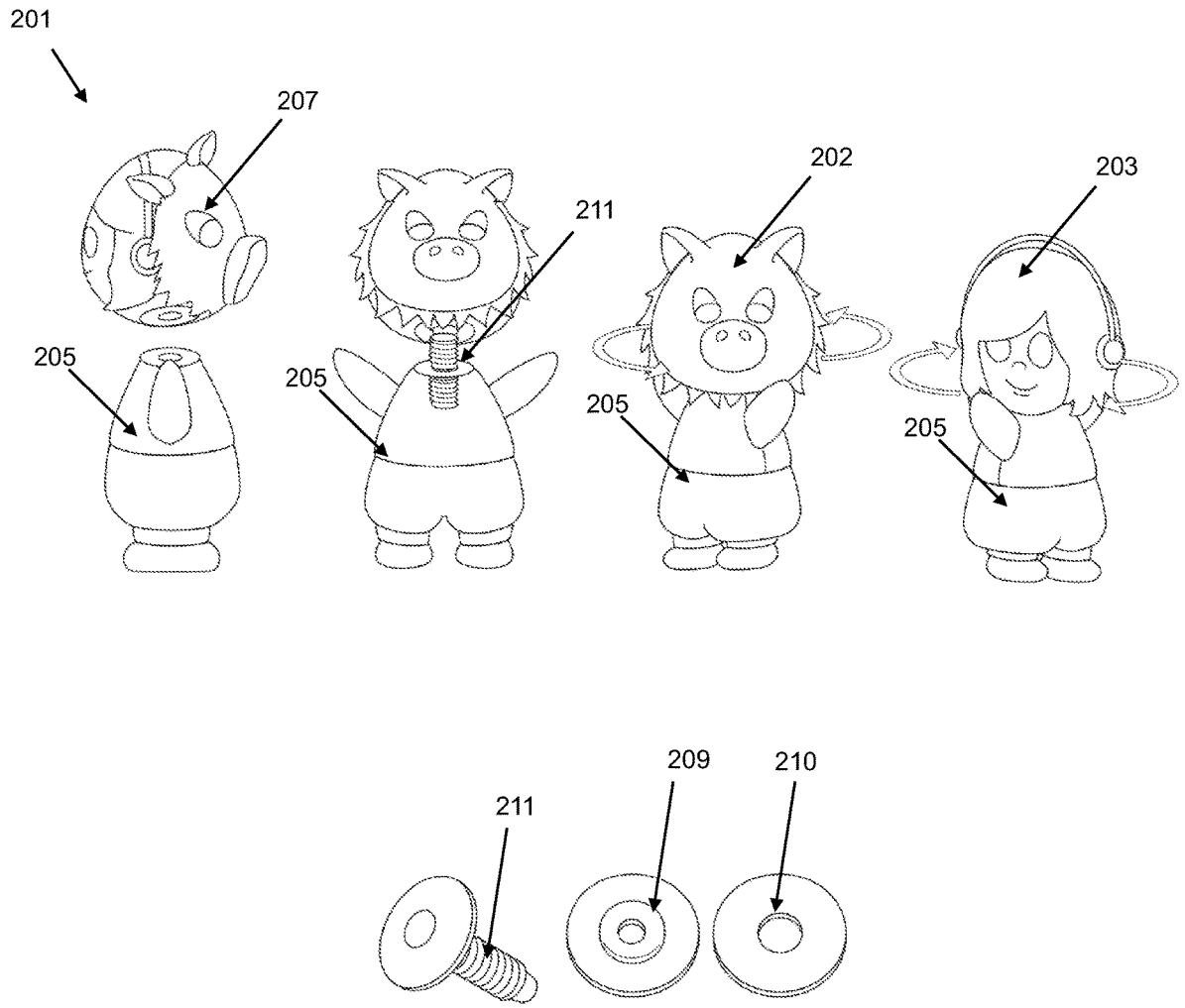
FIG. 4 shows the head attachment hardware for an embodiment of the plush toy.

FIG. 4 shows the mechanics of the attachment of head 207 to plush toy 207 so that it can rotate around its horizontal axis to display the chosen face on the front side of the body. The connection means includes screw post 211, first washer 209 and second washer 210. Screw post 211 is fixably attached to body 205 at one end and head 207 is screwed to the second end by rotating around the threads of the screw. First washer 209 and second washer 210 enable smooth rotation and provide limits to the amount of rotation so head 207 does not easily become detached from body 205. Screw post 211 are made of plastic in the preferred embodiment, but could be formed of any other suitable material well known in the art.

The exterior of the disclosed plush toy can be manufactured using any of many methods well known in the art, but in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. The exterior material for the plush toy can be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art.

The interior material of the plush toy can be formed of many materials well known in the art. While any soft/deformable material will work, the interior of the plush toy disclosed herein may be made from a variety of polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A plush toy with a changeable face comprising:

a body, a head attached to the body, the head further comprising a first face display area on the front of the head and a second face display area on the rear of the head, hair that is configured to cover the head, the hair being moveable from a first position to a second position, the hair further having a first hair side and a second hair side, the first hair side having a portion cut out that aligns with the first face display area or the second face display area, a first face flap having a front first face flap side with a first face and a rear first face flap side with a second face, the first face flap being configured to fit on the head such that the first face or the second face aligns with the first face display area, the first face flap having at least two rectangularly shaped first face flap tabs that are configured to couple the first face flap to the head, a second face flap having a front second face flap side with a third face and a rear second face flap side with a fourth face, the second face flap being configured to fit on the head such that the third face or the fourth face aligns with the second face display area, and the second face display area being visible when the first hair side is aligned with the second face display area.

2. The plush toy with a changeable face of claim 1 further comprising hair attachment tabs attached to the hair.

3. The plush toy with a changeable face of claim 1 further comprising the body, the head, the hair and the face flap made from an exterior material selected from the group consisting of: soft boa fabric, tricot fabric, pearl velvet cloth, wide wale soft boa, polar fleece, velboa, printed polyester, polyester plush material, pile textiles, cotton, mohair, wool, worsted yarn, simulated fur, real fur, silk with a cotton backing, and terry cloth.

4. The plush toy with a changeable face of claim 1 further comprising the body and head filled with a material selected from the group consisting of: polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

5. A plush toy with a changeable face comprising:

a body, a head attached to the body, the head further comprising a face display area, hair that is configured to cover the head, the hair further comprising a moveable hair flap, a face strap for positioning a first face or a second face for display in the face display area, the face strap being accessible through the moveable hair flap, the face strap being operable to move the first face or the second face into the face display area, at least one face attachment tab configured to couple with a first tab opening in the first face or a second tab opening in the second face.

6. The plush toy with a changeable face of claim 5 further comprising the body, the head, the hair and the face flap made from an exterior material selected from the group consisting of: soft boa fabric, tricot fabric, pearl velvet cloth, wide wale soft boa, polar fleece, velboa, printed polyester, polyester plush material, pile textiles, cotton, mohair, wool, worsted yarn, simulated fur, real fur, silk with a cotton backing, and terry cloth.

7. The plush toy with a changeable face of claim 5 further comprising the body and head filled with a material selected from the group consisting of: polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

8. A plush toy with a changeable face comprising:

a body having a front side and a rear side, a head rotationally attached to the body and being configured to rotate around a horizontal axis, the head further comprising a first side with a first face and a second side with a second face where the head can be rotated around the horizontal axis such that either the first face is aligned with the front side or the second face is aligned with the front side, and a moveable face hood attached to the head, the moveable face hood being moveable between a first position and a second position, where in the first position the first face is visible and the second face is hidden and in the second position the second face is visible and the first face is hidden, and where the head is rotated around the horizontal axis such that when the moveable face hood is in the first position, the first face is aligned with the front side and when the movable face hood is in the second position, the second face is aligned with the front side.

9. The plush toy with a changeable face of claim 8 where the head is attached to the body with a screw post.

10. The plush toy with a changeable face of claim 8 further comprising the body, the head, the hair and the face hood made from an exterior material selected from the group consisting of: polyester plush pile material, pile textiles, cotton, mohair, wool, worsted yarn, silk with a cotton backing and terry cloth.

11. The plush toy with a changeable face of claim 8 further comprising the body and head filled with a material selected from the group consisting of: synthetic fibers, batting, cotton, wool, straw, wood wool, plastic pellets and beans.

* * * * *